US006349638B1

(12) United States Patent
Thompson

(10) Patent No.: US 6,349,638 B1
(45) Date of Patent: Feb. 26, 2002

(54) DUAL DIE CHIP COMPACTOR

(75) Inventor: Edward A. Thompson, Kalamazoo, MI (US)

(73) Assignee: Prab, Inc., Kalamazoo, MI (US)

( * ) Notice: Subject to any disclaimer, the term of this patent is extended or adjusted under 35 U.S.C. 154(b) by 0 days.

(21) Appl. No.: 09/395,510

(22) Filed: Sep. 14, 1999

(51) Int. Cl.[7] ..... B30B 11/14

(52) U.S. Cl. ..... 100/218; 100/224; 100/906; 425/261; 425/359

(58) Field of Search ..... 100/218, 224, 100/229 R, 246, 906; 425/261, 359

(56) References Cited

U.S. PATENT DOCUMENTS

| | | | | |
|---|---|---|---|---|
| 975,844 A | * | 11/1910 | Egbert | 100/229 R |
| 1,822,939 A | | 9/1931 | Stout | |
| 2,110,972 A | | 3/1938 | Dinzl | |
| 2,327,117 A | * | 8/1943 | Lorant | 100/224 |
| 2,359,674 A | | 10/1944 | Pollock | |
| 2,830,530 A | | 4/1958 | Powell | |
| 2,892,397 A | | 6/1959 | Finkelstein | |
| 3,416,436 A | * | 12/1968 | Tezuka | 100/218 |
| 3,554,117 A | | 1/1971 | Goldkuhle | |
| 3,651,755 A | | 3/1972 | Gati | |
| 3,736,085 A | | 5/1973 | Mitchell | |
| 3,752,059 A | | 8/1973 | Boyer | |
| 3,811,813 A | | 5/1974 | Taccone | |
| 3,907,474 A | * | 9/1975 | Blaser et al. | |
| 3,980,014 A | | 9/1976 | McEwen et al. | |
| 4,123,210 A | | 10/1978 | Schulz | |
| 4,124,338 A | | 11/1978 | Mitchell | |
| 4,232,600 A | | 11/1980 | Le Jeune | |
| 4,303,412 A | | 12/1981 | Baikoff | |
| 4,389,928 A | | 6/1983 | Burgin | |
| 4,557,190 A | | 12/1985 | Vezzani | |
| 5,039,294 A | | 8/1991 | Gautier et al. | |
| 5,059,372 A | * | 10/1991 | Klais | 425/359 |
| 5,088,399 A | | 2/1992 | Cacace et al. | |
| 5,188,848 A | | 2/1993 | Taddei | |
| 5,391,069 A | | 2/1995 | Bendzick | |
| 5,524,534 A | | 6/1996 | Dietel | |
| 5,542,348 A | | 8/1996 | Bendzick | |
| 5,664,492 A | | 9/1997 | Bendzick | |

FOREIGN PATENT DOCUMENTS

| | | |
|---|---|---|
| CH | 505688 | 4/1971 |
| GB | 1397133 | 6/1975 |
| GB | 2088331 | 6/1982 |
| SU | 617285 | 6/1978 |
| SU | 677951 | 8/1979 |

OTHER PUBLICATIONS

Jorgensen Conveyor, Chi Pactor Brochure, Bulletin 96.
M.C.P. Inc., Puck Master Brochure.

* cited by examiner

*Primary Examiner*—Stephen F. Gerrity
(74) *Attorney, Agent, or Firm*—Olson & Hierl, Ltd.

(57) ABSTRACT

A briquetting machine for compacting metal chips into briquettes with a movable die that provides plural die cavities. After metal chips are loaded into a loading chamber from a hopper, a chip compacting ram pushes the chips at a high speed and low pressure into one of several bores, disposed within a sliding die gate, and against an endplate. The bore and endplate together constitute a die and define at least two die cavities. After the ram reaches a predetermined low pressure, the ram then proceeds at a relatively low speed and relatively high pressure to compress the chips within the die into a briquette. Upon reaching a predetermined compaction pressure, the ram retracts from the bore. After such time, the die gate is moved to a location where one bore lies before an ejector cylinder. The ejector cylinder then extends into the bore, expelling the briquette from the bore.

8 Claims, 5 Drawing Sheets

DUAL DIE CHIP COMPACTOR

TECHNICAL FIELD OF THE INVENTION

This invention relates to briquetting machines; more specifically to machines for compacting a charge of metal chips into a briquette.

BACKGROUND OF THE INVENTION

Metal chips accumulate during the machining of metal workpieces. Because machining processes typically utilize a cutting fluid to lubricate and cool the workpiece during a given operation, the machining processes inevitably generate metal chips permeated with cutting fluid. To minimize production costs, it is economically desirable to use a compactor to separate the cutting fluid from the metal chips to facilitate a re-use of the cutting fluid during subsequent machining processes.

Furthermore, it is economically desirable to salvage the metal chips themselves to allow for their recycle and re-use. Compaction of the metal chips into dense briquettes thus facilitates an improved handling and transportation of the metal chips during the recycling process.

Briquetting machines for compacting metal chips have been proposed and constructed in the past. Such machines essentially comprise a feed hopper that introduces the metal chips into a feed chamber, with a compaction chamber, or die, located downstream for compressing with a ram the metal chips into a briquette. A typical prior briquette compactor utilizes a single die during the compaction process. The inner diameter of the die is sized to accept the insertion of the ram.

During the compaction process, frictional forces necessarily develop between the chips and the inner wall of the die. These frictional forces cause wear on the inner diameter of the die, thus causing a loss of the close tolerance desired between the die and the ram outer diameter. Because a single die subject to repeated compaction cycles is subject to wear, an operator must incur added costs for replacing worn dies.

Prior art briquetting machines fail to provide a compaction process that prolongs die life by reducing the wear of a given die. Thus, there continues to be a need for a method and apparatus for compacting metal charges efficiently while reducing the costs of die replacement. The present invention meets these desires.

SUMMARY OF THE INVENTION

The present invention provides a novel and improved briquetting machine which provides advantages in construction, mode of operation, efficiency and use.

To achieve the foregoing, the present briquetting machine includes a ram that co-acts with a die gate that provides plural die cavities. The die gate is carried on an elongate frame aligned along a horizontal axis. The die gate is movably mounted on the frame so as to be shifted from a first position to a second position. In a preferred embodiment of the invention, the die gate has two through bores disposed therein. The two bores are located side-by-side across the face of the gate and are movable along an axis transverse to that of the frame to positions in registry with the ram.

An endplate is fixably mounted to the frame, adjacent to the back side of the movable die gate and co-acts therewith to define a die cavity. The endplate is of a size less than that of the die gate and is juxtaposed relative to only one of the bores. The die gate, together with the endplate, define a die cavity sized to receive the ram when juxtaposed relative to one another.

The ram is also mounted to the frame, oriented substantially parallel to the longitudinal frame axis, and is proximal to the front face of the die gate. The ram is slidably receivable into one of the two bores and against the endplate when the die gate is in the first of two positions, and is slidably receivable into the other of the two bores and against the endplate when the die gate is in the second of two positions.

A loader for metal chips to be compacted is affixed to the frame. The loader is adapted to dispense a charge of metal chips at a location between the ram and the die gate. The ram, when actuated, compresses the dispensed charge of metal chips into a die in registry therewith to form a briquette.

Two ejectors are mounted to the frame, each aligned para-axial with the frame and the ram. One of the two ejectors is adapted for insertion into one of the two bores when the die gate is in its first of two positions, expelling a formed briquette from the respective bore. The other of the two ejectors is adapted for insertion into the other of the two bores when the die gate is in its second of two positions, expelling a formed briquette from the other respective bore.

Because the die gate defines a pair of die cavities disposed therein, each die cavity is subject to only half of the compression cycles of a die of a single-die, prior art compactor. Thus, production efficiencies are increased and the costs for replacing dies in the present invention due to wear are reduced. Other advantages and features of the present invention will be more readily apparent from the following detailed description of a preferred embodiment of the invention, the drawings, and the appended claims.

DESCRIPTION OF THE PREFERRED EMBODIMENT

Figure 1:
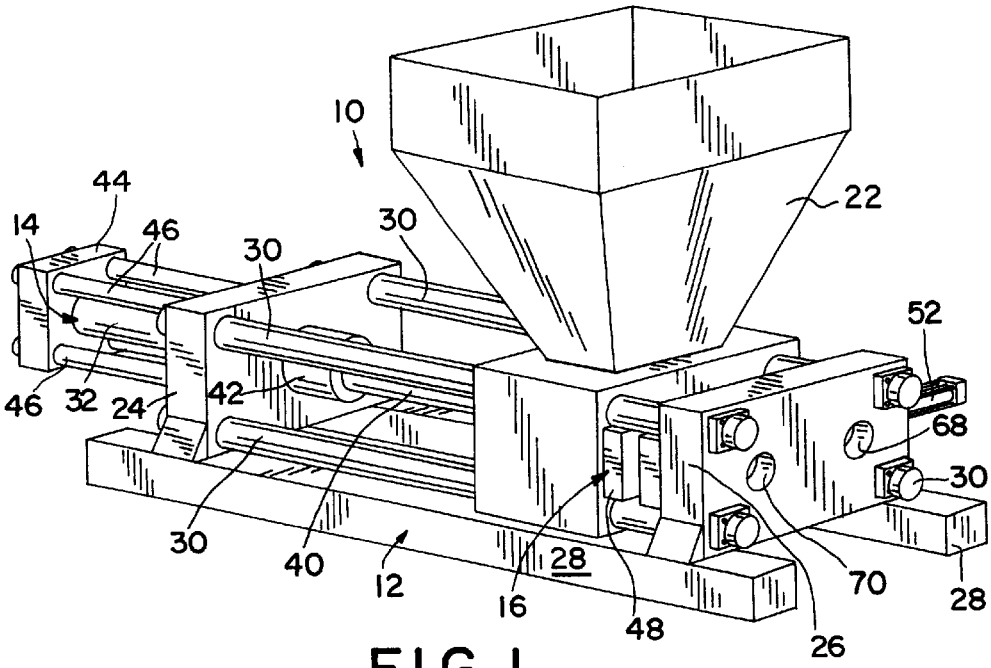
FIG. 1 is a schematic perspective view of a briquetting machine embodying the present invention.

The invention disclosed herein is, of course, susceptible of embodiment in many different forms. Shown in the drawings and described hereinbelow in detail are preferred embodiments of the invention. It is to be understood, however, that the present disclosure is an exemplification of the principles of the invention and does not limit the invention to the illustrated embodiments.

Embodiments of the contemplated apparatus illustrated in the FIGURES show details of mechanical elements that are known in the art and that will be recognized by those skilled in the art as such. The detailed descriptions of such elements are not necessary to an understanding of the invention. Accordingly, such elements are herein represented only to the degree necessary to aid an understanding of the features of the present invention.

For ease of description, a machine embodying the present invention is described hereinbelow in its usual assembled position as shown in the accompanying drawings, and terms such as upper, lower, horizontal, longitudinal, etc., may be used herein with reference to this usual position. However, the machine may be manufactured, transported, sold, or used in orientations other than that described and shown herein.

Figure 2:
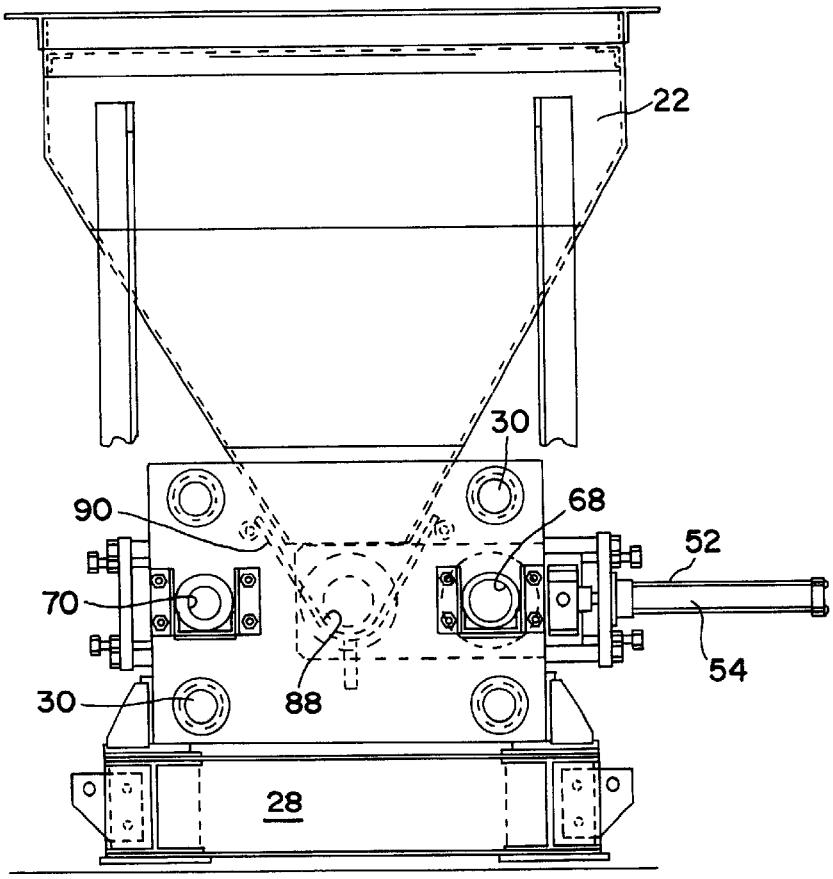
FIG. 2 is a front elevational view of a die end of the briquetting machine embodying the present invention.

Referring to FIGS. 1 and 2, a dual die chip compactor 10 embodying the present invention includes an elongate frame 12, a ram assembly 14, a dual die assembly 16 and a chip loader 22. Frame 12 includes an upstanding end member 24 situated at the actuator end of compactor 10, an endplate 26 situated opposite end member 24, and their supporting base 28. Also conveniently grouped with the components of frame 12 are four tie rods 30 which interconnect upstanding end member 24 to endplate 26.

Figure 3:
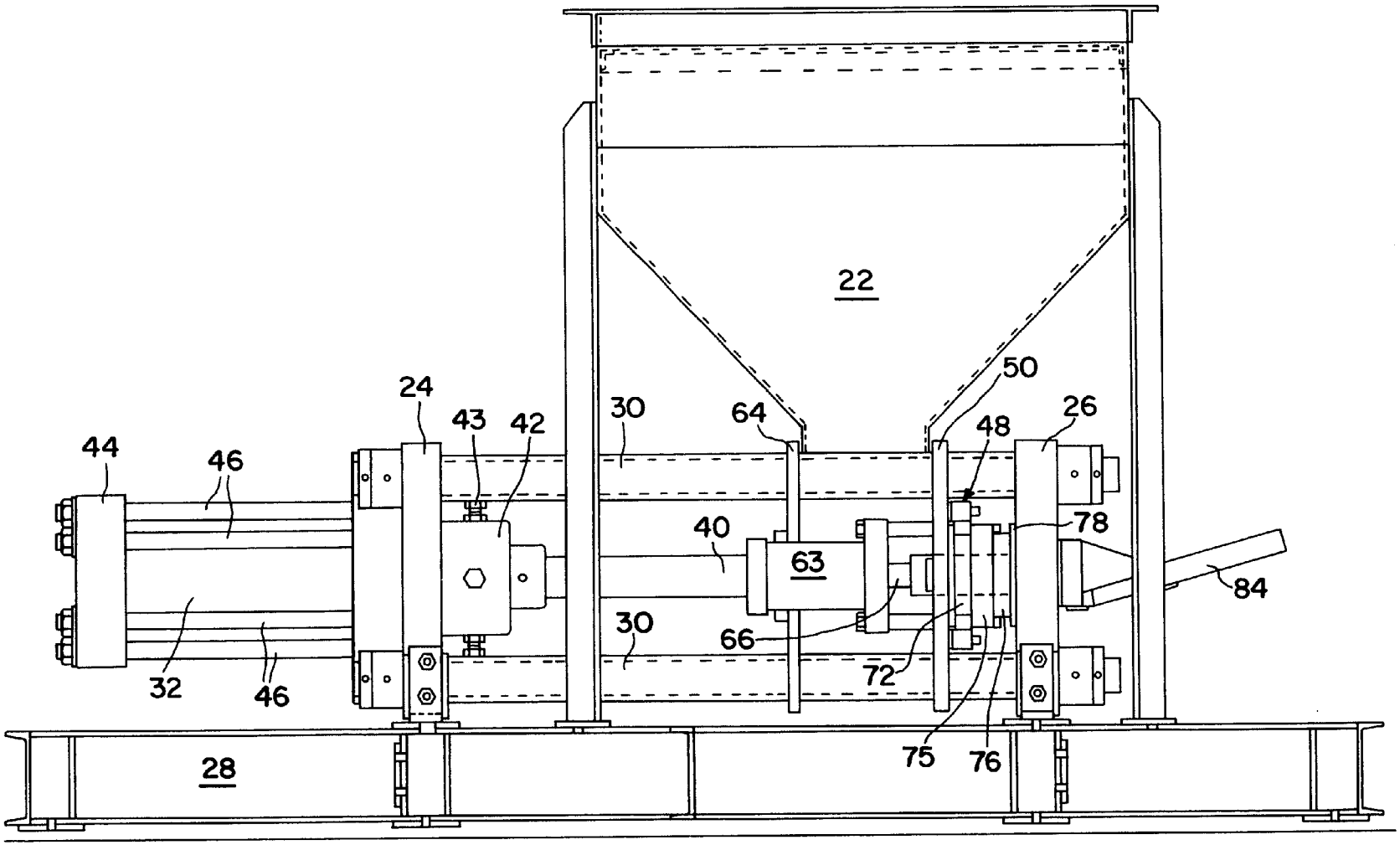
FIG. 3 is a side elevational view of the briquetting machine shown in FIG. 2.
Figure 4:
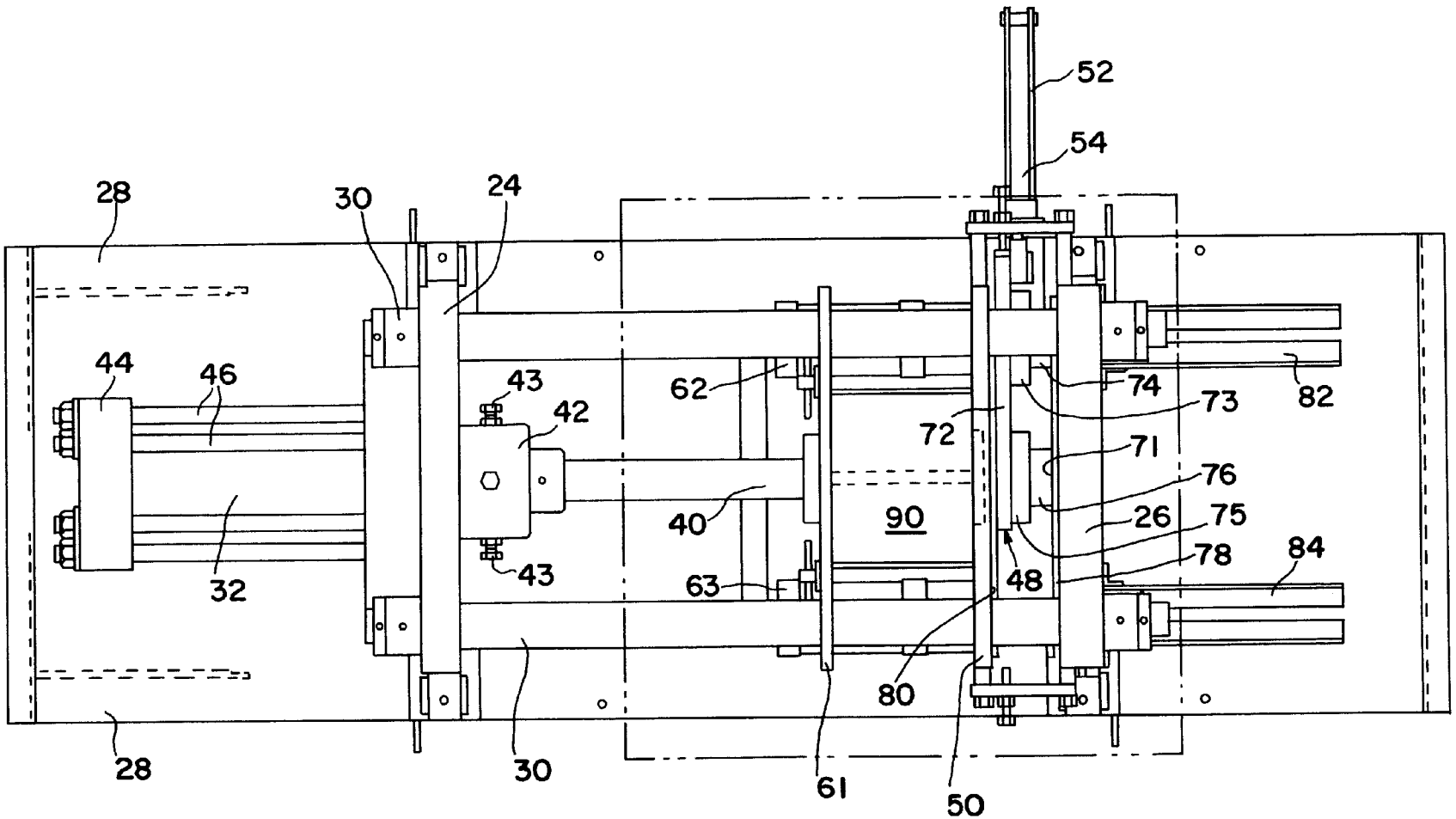
FIG. 4 is a plan view of the briquetting machine shown in FIGS. 2 and 3.

With further reference to FIGS. 3 and 4, hydraulic ram assembly 14 includes a cylinder subframe, a main hydraulic cylinder 32, a chip compactor ram 40, and a ram chuck 42 therebetween for removably mounting ram 40 to the piston (not shown) of cylinder 32. The cylinder subframe secures cylinder 32 to upstanding member 24 and is formed by a plate 44 and four interconnecting tie rods 46. Ram chuck 42 includes a chuck locking bolt 43 and provides a mechanism for replacing and substituting rams.

Figure 5:
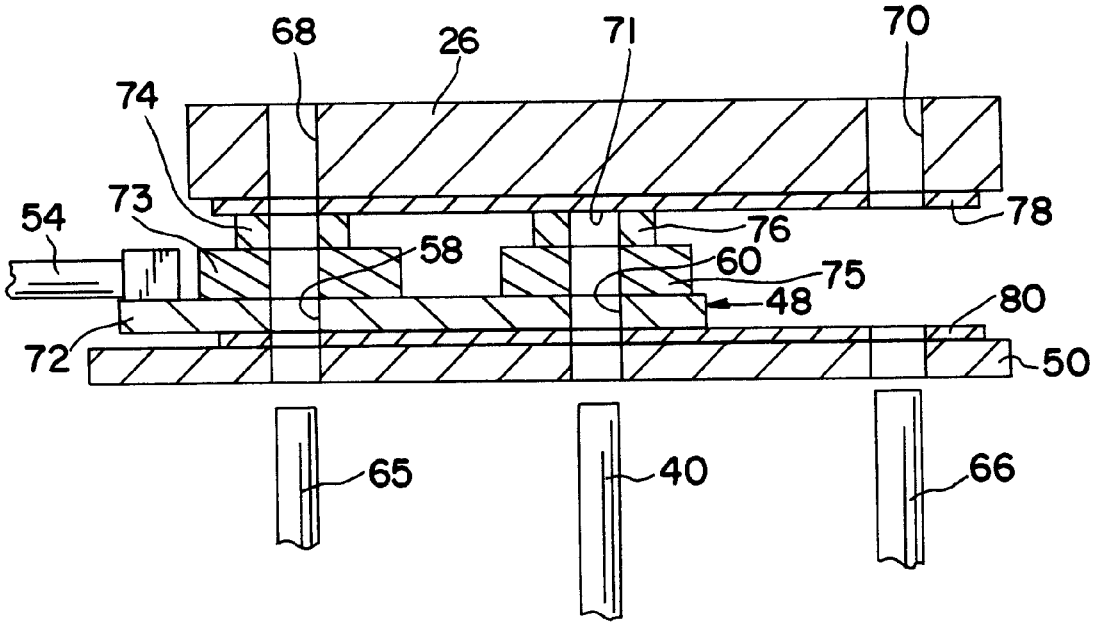
FIG. 5 is a schematic cross-sectional view illustrating selected components of a die assembly of a briquetting machine embodying the present invention.

Situated opposite main cylinder 32 and adjacent endplate 26 is dual die assembly 16. Here, a sliding die gate 48 is mounted between endplate 26 and an opposing die chamber support plate 50. Die gate 48 defines a pair of through bores 58 and 60 (FIG. 5) situated horizontally side-by-side. Each bore has a diameter to accommodate a relatively close insertion of the chip compactor ram 40.

Die assembly 16 also includes a pair of ejector cylinders 62 and 63, which can be hydraulically or pneumatically actuated as desired. Cylinders 62 and 63 are secured to frame 12 by and between support plate 50 and an ejector support plate 64. The two ejector cylinders (or ejectors) are positioned one on each side of ram 40 such that each ejector cylinder is substantially para-axial to the path of ram 40. Each ejector cylinder 62 and 63 is positioned such that their respective piston rods 65 and 66 are in axial alignment with a pair of ejection openings (68 and 70) defined by endplate 26.

More specifically, endplate 26 defines a pair of through ejection openings 68 and 70 on opposite sides of the path of ram 40.

Figure 6:
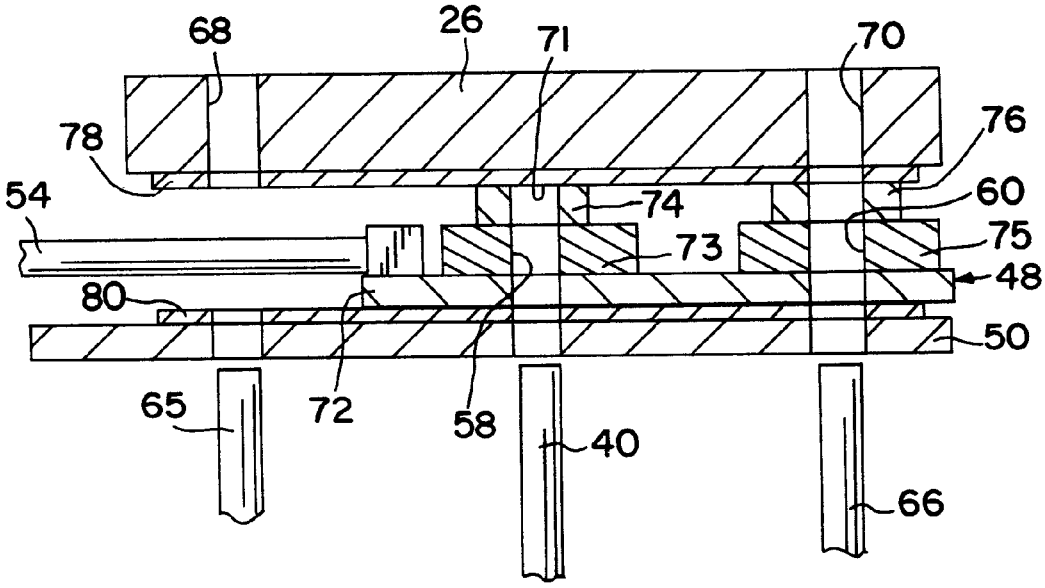
FIG. 6 is a schematic cross-sectional view illustrating the die assembly components of FIG. 6 with the die gate in a second, alternate position.

Die gate 48 is mounted adjacent endplate 26 and ejection openings 68 and 70 to perform a sliding motion between one of two position. As best illustrated by schematic FIGS. 5 and 6 when viewed together, die gate 48 slides from a first position (FIG. 5) where die gate bore 60 is occluded by endplate 26 and defines a first die cavity to a second position (FIG. 6) where die gate bore 58 is then occluded by endplate 26 forming a second die cavity. Each die cavity is adapted to slidably receive ram 40.

The first position of die gate 48 also results in the alignment of die gate bore 58 with ejection opening 68 such that a briquette ejection passageway is defined for receiving ejection piston 65 and thereby clearing a briquette by expulsion from bore 58. Likewise, the second position of die gate 48 results in the alignment of die gate bore 60 with ejection opening 70 to form a second ejection passageway for receiving ejection piston 66.

Referring again to FIGS. 1 through 4, the cross-frame sliding motion of die gate 48 is controlled by a gate cylinder 52 with connecting piston 54. Gate cylinder 52 is affixed to and supported by chamber support plate 50 and endplate 26. To facilitate a horizontal sliding movement of die gate 48, gate cylinder 32 is substantially axially aligned with the horizontal path of die gate 48.

Die gate 48 is preferably modular to facilitate selective replacement of components parts and thereby reduce compactor maintenance costs. As shown, die gate 48 includes a main section 72 and collar plates 73, 74, 75 and 76. Collar plates 73 and 74 together with main section 72 define bore 58, while collar plates 75 and 76 together with main section 72 define bore 60.

Endplate 26 is also preferably modular for cost effective operation. Specifically, endplate 26 can be equipped with a replaceable wear guard 78 to protect endplate 26 from excessive wear or damage. Wear guard 78 serves to absorb frictional and crushing forces exerted on it by the metal chips as ram 40 compacts the chips to form a briquette as well as the sliding frictional forces exerted on it by die gate 48. Wear guard 78 is replaceable, and thus protects endplate 26 from undue wear. Support plate 50 also preferably includes a wear guard 80 to absorb sliding wear from die gate 48 and thereby protect support plate 50.

In operation, metal chips are delivered to die assembly 14 for compaction via a chip loader 22 mounted to frame 12. Loader 22 is vertically oriented over die assembly 14 and contoured to direct metal chips into a loading chamber 88. Although various contours and configurations including conveyor-like systems are suitable for loader 22, a funnel or hopper-like configuration is presently preferred. Loader 22 is preferably equipped with a feed screw (not shown) to move metal chips towards loading chamber 88.

Loading chamber 88 is positioned in the path of ram 40 and is defined by an underlying chip trough 90 mounted to and between ejector support 64 and support plate 50 as best shown in FIGS. 2 and 4.

Metal chips are deposited into loader 22 when chip compactor ram 40 is in a retracted position within main cylinder 32. Loader 22 is contoured to enable a quantity of metal chips to fall into loading chamber 88 under the force of gravity. Alternatively, a feed screw (not shown) can be used within the loader 22 to move the quantity of metal chips into loading chamber 88. The quantity of metal chips placed within loading chamber 88 is dictated by the loading chamber's volume. This volume of chips within loading chamber 88 constitutes a charge of metal chips.

With a charge of metal chips within loading chamber 88, chip compactor ram 40 advances at a relatively high speed and a relatively low pressure to move the charge of chips from the loading chamber 88 into bore 60 and against wear surface 71 until a predetermined pressure is achieved to expel entrapped cutting fluid. After such pressure is reached, ram 40 advances at a relatively lower speed and higher pressure within bore 60 to compact the charge of metal chips into a briquette.

After yet another, relatively higher predetermined pressure is reached during the compaction of the chip charge within bore 60, ram 40 retracts from both bore 60 and loading chamber 88 into main cylinder 32. During this retraction stage of chip compactor ram 40, another charge of metal chips is deposited in loading chamber 88. Also during the ram retraction stage, die gate 48 is moved by gate cylinder 52 from a first position, where bore 60 is juxtaposed to wear surface 71, to an alternate (second) position, where bore 58 is juxtaposed to wear surface 71.

This shift of die gate 48 carries the chip briquette formed in bore 60 into alignment with ejection cylinder 62 and ejection opening 70 of endplate 26. Ejection cylinder 62 expels the briquette from bore 60 while compactor ram 40 advances through loading chamber 88 and bore 58. The relative timing of the briquetting action of ram 40 to an ejection action of cylinders 62 and 63 is not critical. Both the compaction and the rejection are completed, however, before die gate 48 is moved to the next position and the compaction cycle repeated.

Die gate 48 thus shuttles back and forth between at least two positions to enable the cyclic compression of material within a die gate through bore followed by the expulsion of material from the same die gate bore. The repeating cycle is as follows: (1) chip compactor ram 40 compresses material into bore 60 while ejection piston 65 of cylinder 62 expels compressed material from bore 58; (2) after ejection piston 65 and ram 40 retract, die gate 48 is moved into a second position; (3) ram 40 then compresses material into bore 58 while ejection piston 66 of cylinder 63 expels compressed material from bore 60; (4) after ejection piston 66 and ram 40 retract, die gate 48 returns to its first piston to repeat this cycle starting at step (1).

Figure 7:
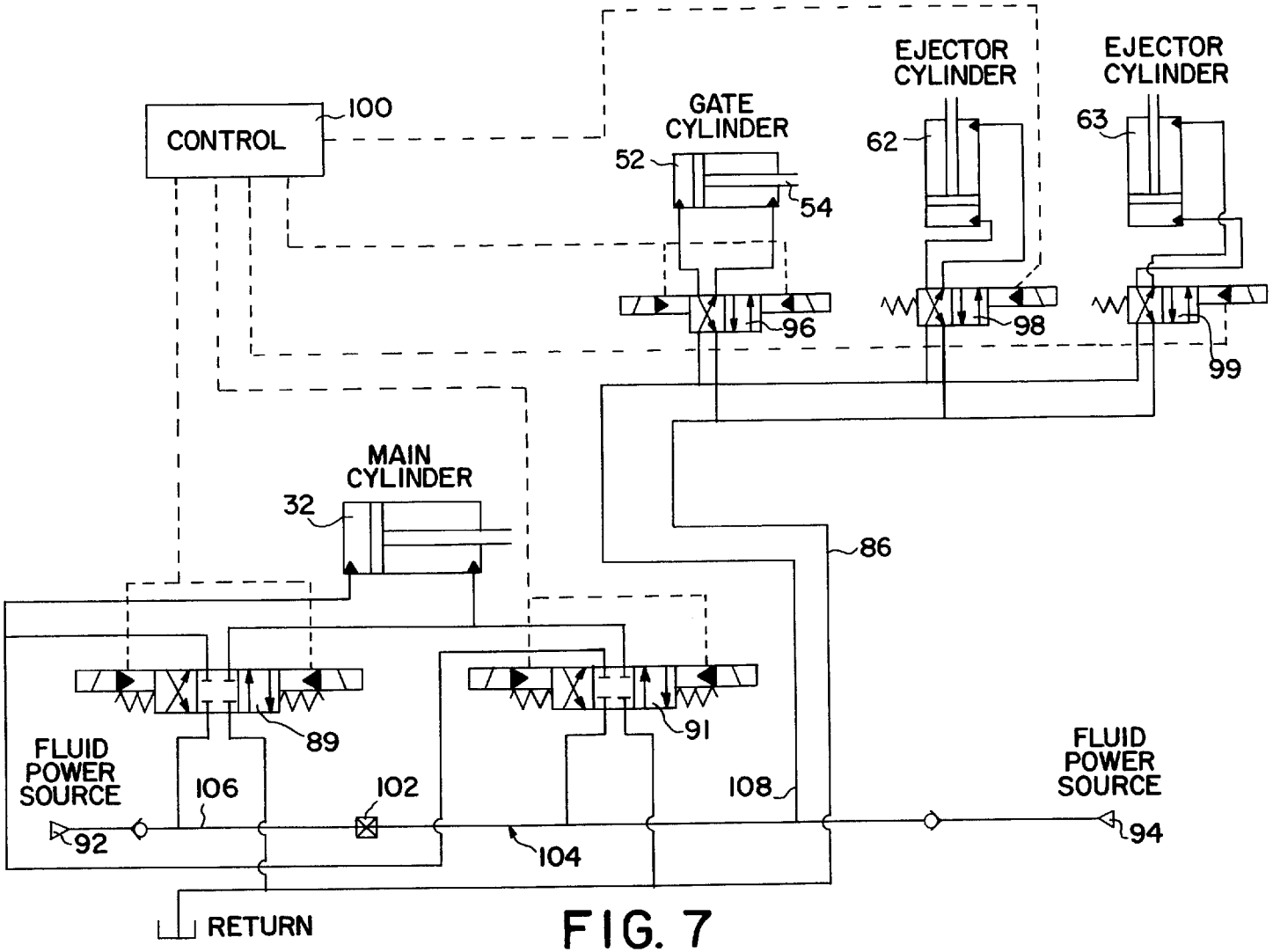
FIG. 7 is a simplified hydraulic circuit diagram for operating a briquetting machine embodying the present invention.

FIG. 7 is a simplified hydraulic circuit for actuating the hydraulic cylinders 32, 52, 62 and 63 of the dual die chip compactor 10 in accordance with the operation described above. A series of control valves are employed to activate the hydraulic cylinders by directing pressurized fluid to one selected side of the cylinder while creating a fluid return path to return line 86 from the other side of the cylinder.

More specifically, a pair of three-position, four-port control valves 89 and 91 are provided for actuating main cylinder 32. Either control valve 89 or control valve 91 may independently serve to reversibly actuate cylinder 32. Two control valves are preferably provided for operational flexibility, load sharing, fault tolerance and increased reliability.

As illustrated in FIG. 7, the use of two control valves (89 and 91) allows for multi-pressure operation of main cylinder 32. With fluid power source 92 providing relatively higher pressure fluid than fluid power source 94, the piston of main cylinder 32 can be extended in two stages of increasing pressure. In the first, lower pressure stage, control valve 91 is energized to create a fluid path from fluid power source 94 to the extension chamber of cylinder 32. In the second stage, control valve 91 returns to center position eliminating the lower pressure path before control valve 89 is energized to create a fluid path from power source 94 to the extension chamber of cylinder 32.

Connecting piston 54 of gate cylinder 52 is extended and retracted via a two-position, four-port control valve 96. Control valve 98 for activating ejector cylinder 62 and control valve 99 for activating ejector cylinder 63 are both two-position, four port valves which include spring loadings such that their normal position maintains the ejector cylinders in their retracted position.

A controller (or controller network) 100 coordinates valve actions to provide the desired sequence of cylinder operation. An optional plug 102 isolates pressurized line 104 into separate line sections 106 and 108.

Additional optional features are contemplated. For example, off-loading chutes 82 and 84 may be mounted to endplate 26 adjacent ejection openings 68 and 70, respectively, to catch expelled briquettes and direct them to predetermined locations (FIG. 4).

A wide variety of conventional materials are suitable for making the components of compactors embodying the present invention. These materials include metals, notably steels, and various high-strength composites without limitation that all or any of the elements be made of the same material. For example, wear guards 78 and 80 may be fabricated from specialized wear-resistant materials.

The foregoing description and the accompanying drawings are illustrative of the present invention. Still other variations and arrangements of parts are possible without departing from the spirit and scope of this invention.

We claim:

1. An apparatus for compacting a charge of metal chips into a briquette and comprising:

a frame;

a die gate movably mounted on said frame from a first position to a second position, said die gate having a plurality of through bores disposed therein;

an endplate fixably mounted to said frame and juxtaposed relative to one of said bores when said die gate is in said first position, said die gate together with said endplate defining a die cavity when juxtaposed relative to one another;

a ram mounted to said frame proximal to said die gate and opposite said endplate, said ram being slidably receivable into said die cavity and against said endplate when said die gate is in said first position;

a loader affixed to said frame and adapted to dispense said charge between said ram and said die gate, said ram compressing said charge into said die cavity to form said briquette; and an ejector mounted to said frame, said ejector adapted for insertion into said bore when said die gate is in said second position for expelling said briquette from said bore.

2. The apparatus in accordance with claim 1 wherein said ram is hydraulically actuated.

3. The apparatus in accordance with claim 1 wherein said ejector is hydraulically actuated.

4. The apparatus in accordance with claim 1 wherein an off-loading chute is provided for said bores.

5. The dual die chip compactor of claim 1 further comprising a frame support plate and a separate frame support wear guard plate, said die gate being positioned between said support plate and said end plate, said support plate and said support wear guard plate include respective aligned first through bores, said hydraulic ram being slidably receivable into said respective first through bores in said support plate and said frame support wear guard plate.

6. A dual die chip compactor for compacting a charge of metal chips into a briquette and comprising:

a frame;

a die gate movably mounted to said frame from a first position to a second position and having a first and a second through bore disposed therein, said die gate including a main section and a separate collar plate mounted against said main section, said main section and said collar plate together defining said first and second through bores;

an endplate fixably mounted to said frame and adjacent to said die gate, said endplate having a first and a second ejection opening disposed therein and a wear surface between said first and said second ejection opening, said first through bore together with said wear surface defining a first die cavity when said die gate is in said first position and said second through bore together with said wear surface defining a second die cavity when said die gate is in said second position;

a ram mounted to said frame proximal to said die gate and opposite said endplate, said ram being slidably receivable into said first bore and against said wear surface when said die gate is in said first position and said ram being slidably receivable into said second bore and against said wear surface when said die gate is in said second position;

a loader affixed to said frame and adapted to dispense said charge between said ram and said die gate, said ram compressing said charge into said first die cavity to form a briquette when said die plate is in said first position and compressing said charge into said second die cavity to form a briquette when said die plate is in the second position; and an ejector mounted to said frame, said ejector being adapted for insertion into said first bore when said die gate is in said second position for expelling a briquette from said second bore through said second ejection opening and said ejector being adapted for insertion into said second bore when said die gate is in said first position for expelling a briquette from said first bore through said first ejection opening.

7. The apparatus in accordance with claim 6 wherein an off-loading chute is provided for each bore.

8. A dual die chip compactor for compacting a charge of metal chips into a briquette and comprising:

a frame;

an endplate mounted to said frame and having a first ejection opening and a second ejection opening disposed therein and a wear surface associated therewith between said first and said second ejection openings;

a separate wear guard plate mounted against said end plate having a first opening aligned with said first ejection opening, a second opening aligned with said second ejection opening and a wear surface associated therewith between said first and second openings therein;

a die gate having a first through bore and a second through bore disposed therein, said die gate being movably mounted to said frame adjacent said endplate and said wear guard plate from a first die gate position where said first through bore together with said wear surface define a first die cavity and said second through bore is substantially, axially aligned with said second ejection opening to a second die gate position where said second through bore together with said wear surface define a second die cavity and said first through bore is substantially, axially aligned with said first ejection opening;

a hydraulic ram mounted to said frame proximal to said die gate and opposite said endplate, said ram being slidably receivable into said first bore and against said wear surface when said die gate is in said first position and said ram being slidably receivable into said second bore and against said wear surface when said die gate is in said second position;

a loader affixed to said frame and adapted to dispense said charge between said ram and said die gate, said ram compressing said charge into said first die cavity to form a briquette when said die plate is in said first position and compressing said charge into said second die cavity to form a briquette when said die plate is in the second position; and a hydraulic ejector mounted to said frame, said ejector being adapted for insertion into said first bore when said die gate is in said second position for expelling a briquette from said second bore and said ejector being adapted for insertion into said second bore when said die gate is in said first position for expelling a briquette from said first bore.

* * * * *